US005245905A

United States Patent [19]

Bundy

[11] Patent Number: 5,245,905

[45] Date of Patent: Sep. 21, 1993

[54] CONTINUOUS BORE EVACUATION SYSTEM

[75] Inventor: Mark L. Bundy, Belcamp, Md.

[73] Assignee: The United States of America as represented by the Secretary of the Army, Washington, D.C.

[21] Appl. No.: 955,187

[22] Filed: Oct. 1, 1992

[51] Int. Cl.[5] ..... F41A 13/06; F41A 13/08

[52] U.S. Cl. ..... 89/1.2; 89/14.1

[58] Field of Search ..... 89/1.2, 14.2, 14.1

[56] References Cited

U.S. PATENT DOCUMENTS

| | | | |
|---|---|---|---|
| 940,101 | 11/1909 | Wetzel | 89/1.2 |
| 1,160,778 | 11/1915 | Smart | 89/1.2 |
| 2,146,554 | 2/1939 | Rossmann | 89/14.1 |
| 2,427,374 | 9/1947 | Walker | 89/14.1 |
| 2,766,661 | 10/1956 | Margulis | 89/1.2 |
| 2,791,940 | 5/1948 | Speake et al. | 89/1.2 |
| 2,807,986 | 10/1957 | Howard et al. | 89/1.2 |
| 3,118,342 | 1/1964 | Campione et al. | 89/1.2 |
| 4,024,790 | 5/1977 | Heiderer | 89/1.2 |

FOREIGN PATENT DOCUMENTS

| | | | |
|---|---|---|---|
| 1131558 | 6/1962 | Fed. Rep. of Germany | 89/1.2 |

OTHER PUBLICATIONS

Bundy, et al, "High Conductivity Thermal Shrouds and Continuous Bore Evacuation System (CBES)," BRL--TR-3336 (May 1992).

*Primary Examiner*—David H. Brown

*Attorney, Agent, or Firm*—Saul Elbaum; Jason M. Shapiro

[57] ABSTRACT

A continuous bore evacuation system for aspirating the noxious gas products associated with the firing of tank rounds and for cooling all or part of the gun barrel between rounds. The bore evacuator employs an annular container which is fixed to the exterior surface of the gun barrel, preferably just ahead of the powder chamber. A plurality of canted ports lead from the container into the bore so that gas products can fill the container after a projectile passes the ports, and a compressed gas can be pumped in through check-valves to continuously clear the bore of gas products after launch. The ports may be arranged in a cochlear manner so that the flow of gas is substantially helical. In another embodiment, an aerosol solvent is injected into the compressed gas to prevent accumulation of propellant residue within the container, check-valves, and bore evacuator holes.

7 Claims, 2 Drawing Sheets

CONTINUOUS BORE EVACUATION SYSTEM

GOVERNMENTAL INTEREST

The invention described herein may be manufactured, used and licensed by or for the U.S. Government for governmental purposes without the payment to me of any royalties thereon.

BACKGROUND OF THE INVENTION

The present invention relates generally to devices for evacuating from a gun bore the gas products associated with the firing of tank rounds. More particularly, the present invention relates to a continuous bore evacuation system which is able to expel noxious gas products and cool a gun barrel thereby improving its performance and the operators' safety.

Conventional bore evacuators are cylindrical canisters which fit around a gun barrel, creating an annular air space between the inside canister wall and the outside barrel surface. The canister is sealed against the barrel using o-rings and other mechanical fasteners, but opens into the gun bore by means of holes, or ports, which are drilled through the barrel wall at an angle. Propellant gases enter the bore evacuator after the projectile passes these bore evacuator ports. When the oxygen-poor propellant gas mixes with the air in the canister, a secondary combustion takes place. This secondary combustion raises the canister pressure two-to-three times what it would normally be were the propellant gas itself merely entrapped. The confined gas exits the bore evacuator after the projectile leaves the barrel and the pressure in the bore begins to drop back to ambient.

The bore evacuator holes are typically drilled at an angle with respect to the bore axis so that as the gas leaves the canister it is directed toward the muzzle. If the breech opening is timed correctly, this muzzle-directed flow acts to draw, or evacuate, the gas upstream of the holes. The evacuation process tends to remove any hot, solid-phase propellant residue left in the gun chamber after firing. It also reduces the amount of noxious, and potentially recombustible gas-phase propellant residue which enters the crew area when the breech is opened.

Under normal operation conventional bore evacuators are able to maintain a safe environment for the gun crew. However, in the event that the breech fails to open properly, the evacuator blow-down may be finished before any residual propellant particulates or gases are swept out of the chamber. Such a malfunction increases the possibility of a flareback in the crew area, or a hot residual ember preigniting the next round when it is loaded.

Another factor which can adversely affect the purging of bore gases in a conventional bore evacuator is a head wind, either natural, or due to the forward motion of the vehicle. With a strong head wind, bore evacuation is diminished.

Finally, the intensity of the evacuation process during blow-down has been observed to decline with the round count, owing to the drop-off in secondary combustion caused by a depletion in the oxygen content of the residual gas in the sealed canister. The replacement of residual canister gas with ambient air in a conventional bore evacuator is a slow process which can take several hours of cease-fire.

SUMMARY OF THE INVENTION

Accordingly, it is an object of the present invention to provide a bore evacuation device which can adequately purge the noxious gas products and solid residue associated with the firing of tank ammunition in the event of a breech failure.

It is another object of the present invention to provide a bore evacuation device which replenishes the oxygen necessary for a secondary combustion to occur in the bore evacuator canister.

Another object of the present invention is to actively cool the gun barrel by creating a continuous flow of external air through part or all of the gun bore.

It is still another object of the present invention to provide a bore evacuation device which reduces the possibility of flare-back in the crew cabin of a tank or pre-ignition of ammunition in the chamber.

It is yet another object of the present invention to provide a bore evacuation device which decreases the time necessary for cleaning and maintaining the bore evacuation ports between the canister and the gun bore.

These objects and others not specifically enumerated are accomplished with an annular container which is fixed to the exterior surface of the gun barrel, preferably just ahead of the powder chamber. A plurality of canted ports lead from the container into the bore so that gas products can fill the container after a projectile passes the ports, and a compressed gas can be pumped in to clear the bore of gas products after launch and replenish the oxygen content within the container between rounds. The ports may be arranged in a cochlear manner so that the flow of gas is substantially helical. In another embodiment, an aerosol solvent is injected into the compressed gas to prevent carbon build-up within the container and the ports.

BRIEF DESCRIPTION OF THE DRAWINGS

The preferred embodiments of the present invention will be described with reference to the accompanying drawings in which.

DESCRIPTION OF THE PREFERRED EMBODIMENTS

Figure 1:
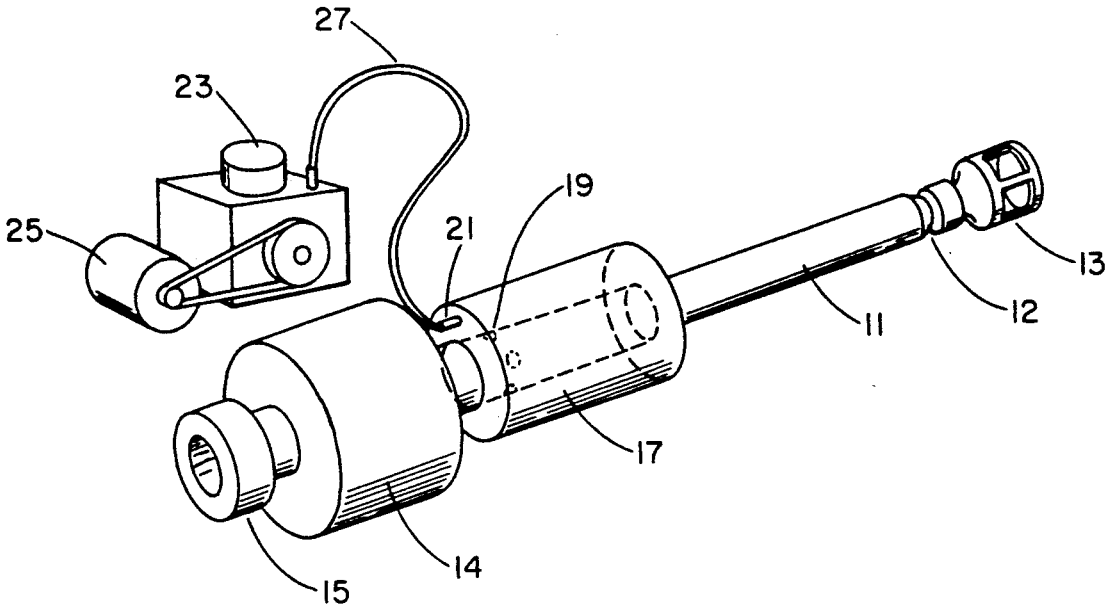
FIG. 1 is a perspective view of a continuous bore evacuation system according to the present invention.

Referring now to FIG. 1, a conventional tank gun is shown having a tapered barrel 11, a muzzle 12 (with or without a muzzle brake 13), a recoil mechanism 14, and a breech opening 15. An annular pressure vessel, or container 17, is located ahead of the recoil mechanism 14, and attached to the gun barrel 11 so as to create an air-tight cavity. Like a conventional bore evacuator, the container 17 is typically a cylindrical sleeve which is fitted over the gun barrel 11 in a concentric manner to create an air-tight annulus. A plurality of canted ports 19 are arranged circumferentially about the barrel 11 in the region beneath the annular container 17.

The container 17 is provided with one or more external ports, each of which hosts a check-valve 21. A gas compressor 23, driven by a motor 25, continuously supplies compressed gas to the container 17, by means of an air hose 27 which connects to one or more of the check-valves 21. When the gas pressure inside the container 17 exceeds the supply pressure, the check-valve 21 closes, allowing the container 17 to function in a conventional manner. (The supply pressure is on the order of 10 psi, whereas the pressure of the trapped propellant as will typically be about 100 psi.) Both the gas compressor 23 and motor 25 are conventional, and preferably able to be driven by a power supply internal to the vehicle. A preferred gas is air, because of the availability of air compressors and the improvement in secondary combustion which is achieved through its use.

Figure 2:
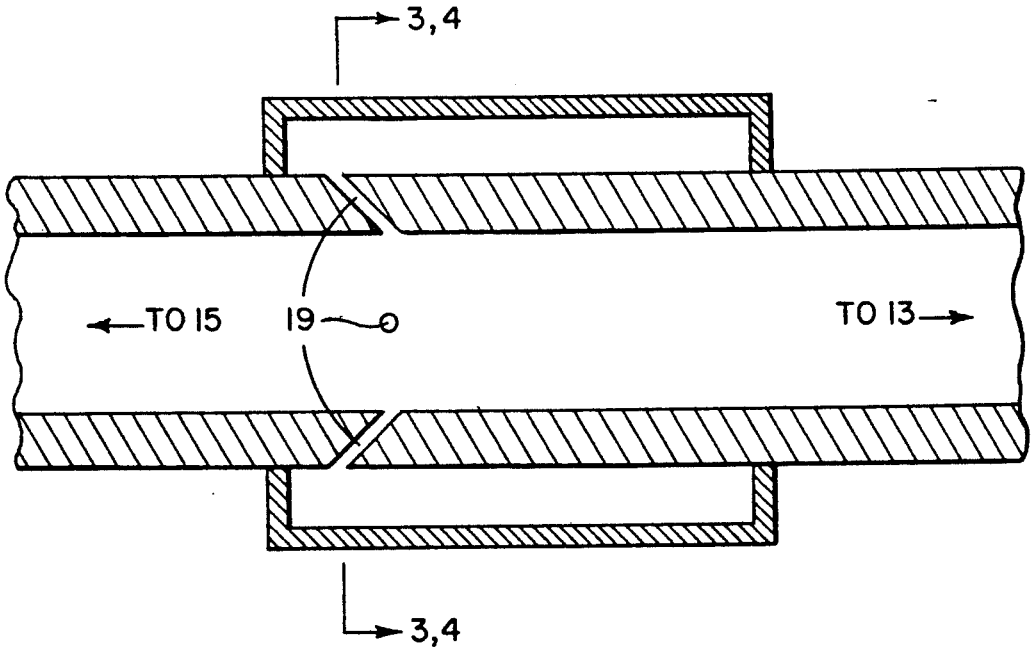
FIG. 2 is a cross-sectional view of the bore evacuator container and canted inlet ports.
Figure 3:
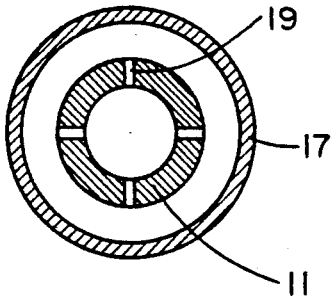
FIG. 3 is a view of the container and traditionally canted ports taken along line 3—3 of FIG. 2.

FIGS. 2 and 3 illustrate the forward cant of the inlet ports 19 which extend from the annular cavity defined by the cylindrical container 17 into the gun bore 33. Both the diameter of the ports 19 and their cant angle are conventional and well known in the art. When a projectile passes these ports 19, the gas products of combustion are collected in the container 17 until such time as the projectile exits the muzzle 13. When the bore pressure drops below that of the gas pressure in the container 17, the trapped gases begin to flow out through the ports 19 in the direction of the muzzle 12. This process, known as blow-down, continues until the pressure within the container 17 reaches ambient bore pressure.

The breech 15 is opened either manually or automatically after a round is fired, so that the blow-down flow entrains residual propellant gases and particles upstream of the ports 19. This clearing process reduces the quantity of noxious, and potentially combustible, propellant gas residue that would otherwise escape into the crew compartment. If the residue is allowed to mix with the air in the cabin it can give rise to a secondary combustion, known as flare-back. Notwithstanding conventional bore evacuation methods, it is also possible for hot particulate residue to remain in the powder chamber of the gun, posing a hazard when rapid-fire loading is attempted.

By continuously injecting a compressed gas into the evacuation container 17 before and after conventional evacuation takes place, the present invention reduces the hazard of flare-back and accidental ignition by improving the expulsion of gas products and solid residue. In addition to improving crew safety, the continuous evacuation improves gun accuracy by reducing cross-barrel temperature differences, and reduces gun tube wear by actively cooling the barrel between rounds.

The present invention continuously cools the gun tube 11 between rounds through forced convection. Cooling the barrel 11 is considered beneficial because it is known that barrel wear increases with barrel temperature. A cool barrel 11 is also less likely to cause ammunition cook-off (the pre-ignition of chambered ammunition due to excessively high chamber wall temperatures). Less well known is the fact that the adverse effects of thermal droop on gun accuracy diminishes with decreased barrel temperature.

Figure 4:
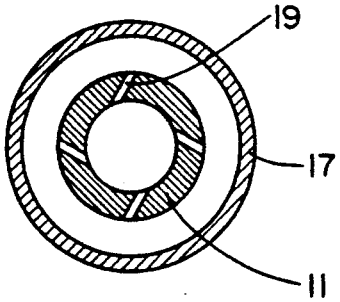
FIG. 4 is a view of the container and cochlear ports according to an alternate embodiment of the present invention and taken along line 4—4 of FIG. 2.

In another embodiment of the present invention, illustrated in FIG. 4, the ports 19 leading from the cavity defined by the evacuation container 17 into the gun bore 33 are given a circumferential cant (i.e. a cochlear arrangement) as well as a forward cant. In this manner, the removal of heat from the gun barrel 11 is accomplished more uniformly and symmetrically. The helical gas flow induced by the cochlear arrangement of ports 19 makes removal of heat more circumferentially unbiased downstream from the container 17. By placing the container 17 as close as possible to the powder chamber, or breech 15, the present invention is also able to cool a greater portion of the gun tube 11 than existing bore evacuators.

When compressed air is used, there is an increased likelihood of inducing secondary combustion of the propellant gas as it enters the oxygen-rich cavity defined by the annular container 17 This type of secondary combustion has been observed to increase the internal pressure in the container 17 approximately two-fold, resulting in a more efficient bore evacuation process.

Figure 5:
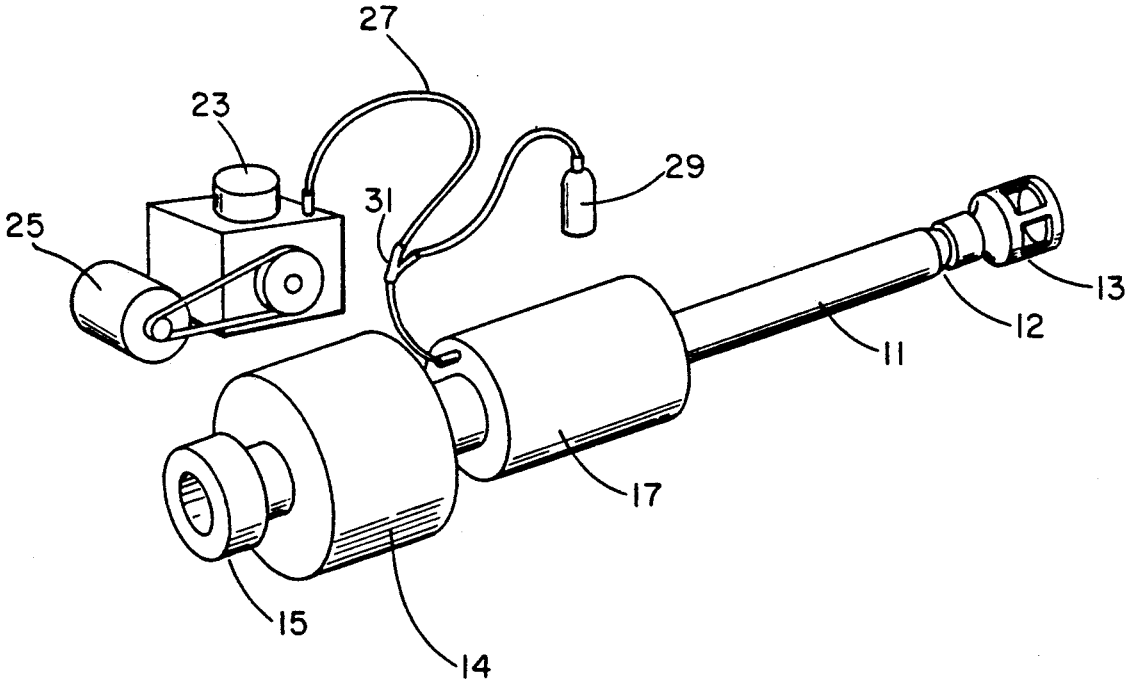
FIG. 5 is a perspective view of the continuous bore evacuation system with aerosol injection of a solvent.

In yet another embodiment of the present invention, illustrated in FIG. 5, an aerosol solvent 29 is periodically or continuously injected into the gas line 27, perhaps through a "Y" connector 31. This helps remove the carbon build-up which can occur in a check-valve 21 or in any of the canted ports 19, and reduces the time needed for maintenance and cleaning of the bore evacuator.

While there has been described and illustrated specific embodiments of the invention, it will be obvious that various changes, modifications and additions can be made herein without departing from the field of the invention which should be limited only by the scope of the appended claims.

I claim:

1. A bore evacuator for aspirating noxious gas products from the muzzle end of a gun barrel, said bore evacuator comprising an annular container which is fixed to the exterior surface of said gun barrel, a plurality of canted ports leading forwardly from said container into said bore, a compressed gas source, and means for creating a continuous flow of said compressed gas into said container.

2. A bore evacuator for aspirating noxious gas products from the muzzle end of a gun barrel, said bore evacuator comprising an annular container which is fixed to the exterior surface of said gun barrel, a plurality of canted ports leading forwardly from said container into said bore, one or more check-valves on the exterior surface of said annular container, a compressed gas source, and means for creating a continuous flow of said compressed gas through one or more of said check valves and into said container.

3. A bore evacuator for aspirating noxious gas products from the muzzle end of a gun barrel, said bore evacuator comprising an annular container which is fixed to the exterior surface of said gun barrel, a plurality of canted ports leading forwardly from said container into said bore, a compressed gas source, and means for creating a continuous flow of said compressed gas into said container, said ports being arranged in a cochlear manner so that said flow of gas is substantially helical.

4. A bore evacuator for aspirating noxious gas products from the muzzle end of a gun barrel, said bore evacuator comprising an annular container which is fixed to the exterior surface of said gun barrel, a plurality of canted ports leading forwardly from said container into said bore, a compressed gas source, means for injecting an aerosol solvent into said compressed gas, and means for creating a continuous flow of said compressed gas and solvent into said container.

5. The invention of claim 1, 2, 3 or 4 wherein said gas is air.

6. The invention of claim 1, 2, 3 or 4 wherein said annular container is placed immediately ahead of the gun powder chamber near the base of said barrel.

7. A bore evacuator for aspirating noxious gas products from the muzzle end of a gun barrel, said bore evacuator comprising an annular container which is fixed to the exterior surface of said gun barrel immediately ahead of the powder chamber, a plurality of canted ports leading forwardly from said container into said bore, a compressed gas source, means for injecting an aerosol solvent into said compressed gas, and means for creating a continuous flow of said compressed gas and aerosol solvent into said container, said ports being arranged in a cochlear manner so that said flow of gas is substantially helical.

* * * * *